US009222241B2

(12) United States Patent
Graeve

(10) Patent No.: US 9,222,241 B2
(45) Date of Patent: Dec. 29, 2015

(54) INDEPENDENT SUPPLY AND EXHAUST METERING WITHIN A VALVE CASTING

(75) Inventor: Joshua D. Graeve, Peosta, IA (US)

(73) Assignee: DEERE & COMPANY, Moline, IL (US)

( * ) Notice: Subject to any disclaimer, the term of this patent is extended or adjusted under 35 U.S.C. 154(b) by 999 days.

(21) Appl. No.: 13/167,318

(22) Filed: Jun. 23, 2011

(65) Prior Publication Data

US 2012/0324874 A1 Dec. 27, 2012

(51) Int. Cl.

| | |
|---|---|
| ***F15B 11/024*** | (2006.01) |
| ***E02F 9/22*** | (2006.01) |
| ***F15B 13/02*** | (2006.01) |
| ***F15B 13/04*** | (2006.01) |

(52) U.S. Cl.

CPC ..... *E02F 9/2267* (2013.01); *F15B 13/021* (2013.01); *F15B 13/024* (2013.01); *F15B 13/0402* (2013.01); *Y10T 137/86646* (2015.04)

(58) Field of Classification Search

CPC ..... F15B 11/024; F15B 13/021; F15B 2211/3058

USPC ..... 91/454, 455, 450; 60/421

See application file for complete search history.

(56) References Cited

U.S. PATENT DOCUMENTS

| | | | | |
|---|---|---|---|---|
| 5,372,060 | A * | 12/1994 | Maruyama et al. | 91/454 |
| 5,921,279 | A * | 7/1999 | Barber | 137/596.16 |
| 6,691,604 | B1 * | 2/2004 | Hajek et al. | 91/454 |
| 6,694,860 | B2 * | 2/2004 | Yoshino | 91/454 |
| 7,204,084 | B2 * | 4/2007 | Ma et al. | 91/446 |
| 7,500,360 | B2 * | 3/2009 | Udagawa et al. | 60/421 |

* cited by examiner

*Primary Examiner* — F. Daniel Lopez

(74) *Attorney, Agent, or Firm* — Taft Stettinius & Hollister LLP; Stephen F. Rost

(57) ABSTRACT

The present disclosure provides a hydraulic system for controlling a load. The system includes a housing defining an inlet, a first port, and a second port. The system further includes a spool valve and a proportional control element. The spool valve is in fluid communication with the inlet and the second port and the proportional control element is in fluid communication with the first port. The proportional control element can be controllable to exhaust fluid from the first port to a reservoir. In this arrangement, the proportional control element and the spool valve are controlled independently of one another.

17 Claims, 3 Drawing Sheets

INDEPENDENT SUPPLY AND EXHAUST METERING WITHIN A VALVE CASTING

FIELD OF THE INVENTION

The present invention relates to fluid flow within a valve casting, and in particular to an independent supply and exhaust metering of the fluid flow.

BACKGROUND OF THE INVENTION

Many off road work vehicles, such as a four wheel drive loader of backhoe, can include a work implement such as a bucket or boom. Referring to FIG. 1, an exemplary embodiment is shown of an off road work vehicle in the form of a four wheel drive loader 100. The vehicle 100 includes a front frame assembly 102 and a rear frame assembly 104 that are pivotally joined together at an articulation pivot or joint 116. The front frame assembly 102 can be supported by a front drive wheel 110 and the rear frame assembly 104 can be supported by a rear drive wheel 112. The front frame assembly 102 is also provided with a work implement in the form of a loader bucket 106 that is controllably coupled to the front frame assembly 102 by a coupler or mechanical linkage 108. In other embodiments, the front frame assembly 102 can be coupled with a pair of forks, a blade, a rotary tiller, a roller level, a rotary cutter, a trencher, and other known work implements. The rear frame assembly 104 can include an operator cab 114 in which an operator controls the vehicle 100.

The work implement can be controlled hydraulically using one or more conventional spool valves. A conventional spool valve can meter inlet and exhaust fluid flow through a housing to control the raising and lowering of the work implement. Fluid metering between a hydraulic cylinder, pump, and tank reservoir controls the work implement during operation. The cylinder can be controlled by the speed at which fluid flows through the inlet and exhaust passages of a valve housing. In a conventional housing, the conventional spool valve is either open or closed to fluid flow and thus there is no independent metering of flow.

In the embodiment of FIG. 1, for example, the loader bucket 106 can be lowered from a raised position (not shown) to a lowered position (as shown). To do so, the loader bucket 106 is lowered in the direction of gravity creating an overrunning load condition. To prevent the loader bucket 106 from uncontrollably collapsing to the lowered position, fluid flows through a conventional spool valve. In particular, the conventional spool valve is controlled to an open position to form a restriction in the hydraulic system, e.g., exhaust flow from the hydraulic cylinder to the tank reservoir. However, in the lowered position, the conventional spool valve continues to remain in the open position to allow fluid to flow into the hydraulic cylinder, but the restriction remains as flow is exhausted. In other words, in a conventional spool valve arrangement, there is always a restriction because the inlet and exhaust cannot be independently controlled. As a result, there is unnecessary waste of energy through the conventional spool valve. To overcome this disadvantage, conventional hydraulic systems require multiple spool valves and a redesigned valve housing to incorporate the additional spool valves.

A need therefore exists to provide an improved way of metering flow through a hydraulic system to overcome the disadvantages of conventional spool valves without redesigning the valve housing and incorporating additional spool valves.

SUMMARY

In one exemplary embodiment of the present disclosure, a hydraulic system is provided for controlling a load. The system includes a housing defining an inlet, a first port, and a second port. The system further includes a spool valve and a proportional control element. The spool valve is in fluid communication with the inlet and the second port and the proportional control element is in fluid communication with the first port. The proportional control element can be controllable to exhaust fluid from the first port to a reservoir. In this arrangement, the proportional control element and the spool valve are controlled independently of one another.

The proportional control element can include a solenoid or pressure relief orifice. The control element can also comprise an open and closed positions with the second port being in fluid communication with the inlet in the open position. In form of this embodiment, the system includes a hydraulic cylinder being in fluid communication with the first port and the second port. In another form thereof, a pump is in fluid communication with the inlet. Alternatively, an inlet valve is disposed near the inlet and is configured to fluidly couple the pump to the first port.

In addition, the system can include a bridge channel defined in the housing. The bridge channel can be fluidly coupled between the inlet and the first port. Also, the system can include a compensator valve disposed in the housing between the first port and the second port. The compensator valve is in fluid communication with the spool valve and configured to maintain a pressure drop across the spool valve.

In another embodiment, a method is provided for hydraulically controlling a work implement in a work vehicle. The method includes (a) providing a hydraulic pump, a hydraulic cylinder, a valve housing, a spool valve, and a proportional control element, the valve housing defining an inlet, a first port, and a second port; (b) pumping fluid from the pump to the cylinder through the inlet; (c) controlling the spool valve in an open position to permit fluid flow from the inlet to the first port; (d) exhausting fluid through the proportional control element; and (e) pressurizing the cylinder to control the work implement. The exhausting step can comprise controlling the proportional control element or activating a solenoid. The method can also include controlling the spool valve and proportional control element independent of one another.

In a different embodiment of the present disclosure, a hydraulic system is provided for controlling a work element attached to an off road work vehicle. The system can include a housing defining an inlet, a first port, and a second port; a pump configured to be in fluid communication with the inlet; a cylinder assembly having a first end fluidly coupled to the first port and a second end fluidly coupled to the second port; a single spool valve disposed in the housing, the spool valve being moveable to an open position to fluidly couple the inlet and the first port; and a proportional control element disposed in the housing and being in fluid communication with the second port; wherein, the single spool valve and the proportional control element are controlled independent of one another.

In one form of this embodiment, the system can include an inlet valve disposed near the inlet, wherein the inlet and first port are fluidly coupled when the inlet valve and spool valve are disposed in open positions. In another form thereof, the system can include a fluid path defined between the inlet and first port, the fluid path including a bridge portion between the spool valve and first port. In an alternative form thereof, the system can include a compensator valve disposed substantially longitudinally in the housing between the first port and the second port, the compensator valve being in fluid communication with the spool valve and configured to maintain a relatively constant pressure drop across the spool valve.

The system can further include a tank reservoir in fluid communication with the pump; and a solenoid for controlling the proportional control element; wherein, the solenoid causes the proportional control element to exhaust fluid from the second port to the tank reservoir without moving the spool valve.

The hydraulic system can also include a first flow path defined in the housing and in fluid communication with the inlet and the first port; and a second flow path defined in the housing and in fluid communication with the second port; wherein the first flow path and second flow path are at least partially parallel to one another.

In addition, the hydraulic system can include a first configuration in which the spool valve is in an open position and the proportional control element is in a closed position, where the inlet is fluidly coupled to the first port; a second configuration in which the spool valve is in a closed position and the proportional control element is in an open position, where fluid can flow from the second port past the proportional control element; and a third configuration in which the spool valve and proportional control element are both open, where the first port, second port, and inlet define a fluid path with a reservoir and a pump.

In the present disclosure, the hydraulic system provides a means for independently controlling a single spool valve and proportional control element. The spool valve can fluidly couple a hydraulic pump and cylinder to raise and lower a work element, for example, whereas the proportional control element can exhaust fluid pressure to assist with lowering the work element. The proportional control element can be opened or closed independently of the spool valve, so when there is no need to exhaust pressure, the proportional control element can be closed. This decreases the amount of energy wasted by conventional hydraulic systems.

In addition, the hydraulic system can be such that the valve casting is not redesigned to incorporate additional spool valves to assist with pressurizing and exhausting fluid pressure in the system. The expense of redesigning and casting a new valve housing is therefore avoided by the embodiments of the present disclosure.

BRIEF DESCRIPTION OF THE DRAWINGS

The above-mentioned aspects of the present invention and the manner of obtaining them will become more apparent and the invention itself will be better understood by reference to the following description of the embodiments of the invention, taken in conjunction with the accompanying drawings, wherein.

Corresponding reference numerals are used to indicate corresponding parts throughout the several views.

DETAILED DESCRIPTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

Figure 1:
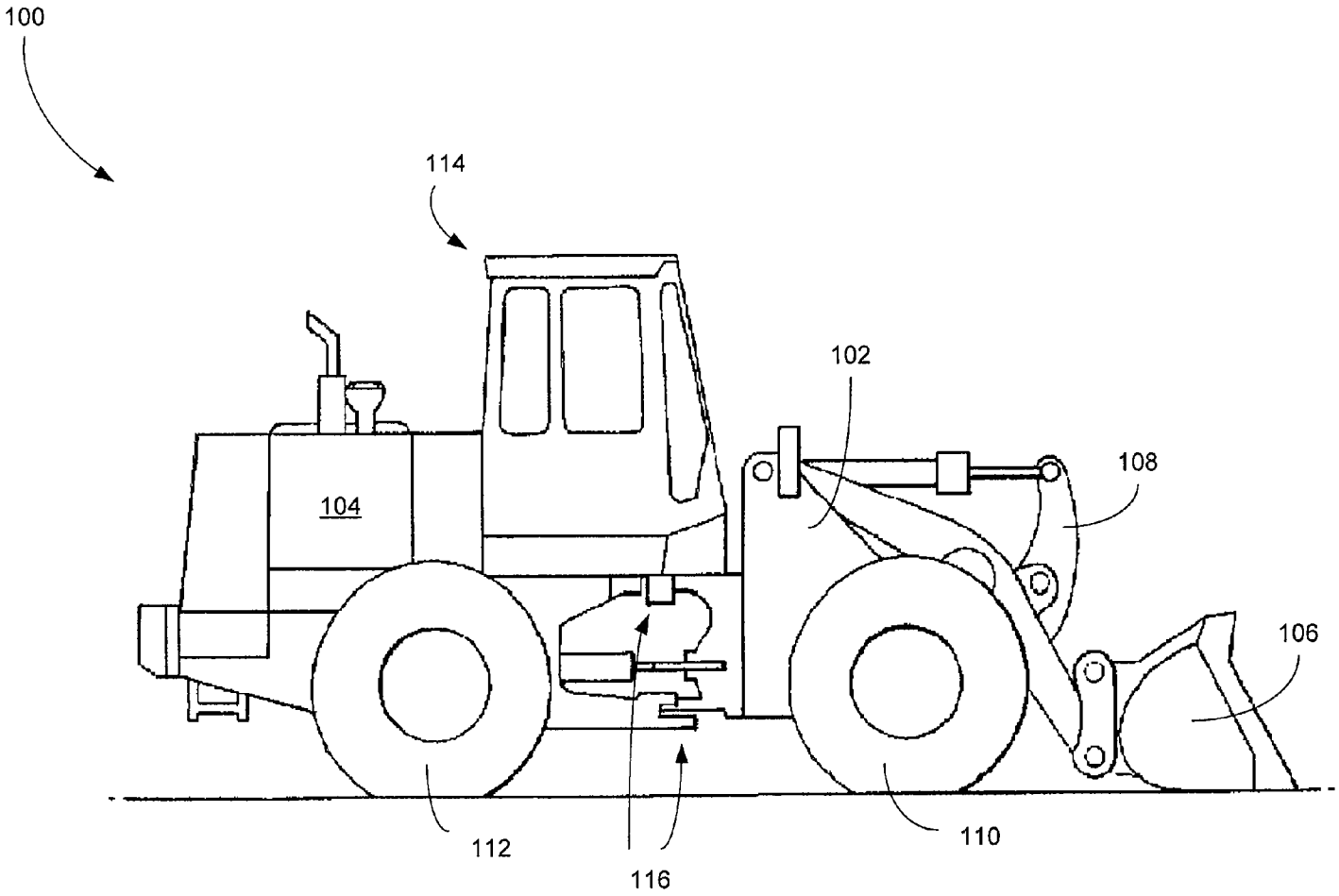
FIG. 1 is a side view of a front wheel drive loader.

In the present disclosure, an improved hydraulic system is provided for permitting independent control of inlet and exhaust metering of hydraulic fluid for the control of a work implement. Referring to FIG. 1, an exemplary embodiment of the improved hydraulic system 200 is shown. The system 200 can include a hydraulic cylinder 202 for pressurizing a hydraulic fluid 246 such as oil to raise and lower the work implement. The hydraulic cylinder 202 includes a rod 204 that moves back and forth between a first end 206 and a second end 208 of the cylinder 202. Hydraulic fluid 246 can collect in a tank reservoir 212 and be transported to the first end 206 of the cylinder 202 by a pump 210. In this configuration, the pump 210 is in fluid communication with the hydraulic fluid 246 in the tank reservoir 212. The pump can be any hydraulic pump known to the skilled artisan.

The system also includes a valve body or housing 214. The valve housing 214 can be made of any cast or forged material. The housing 214 can include an inlet 216 through which fluid enters the valve housing 214 via the pump 210. The housing can further include a first port 218 and a second port 220. As shown, the first port 218 is in fluid communication with the first end 206 of the cylinder 202 via a first channel 236 and the second port 220 is in fluid communication with the second end 208 of the cylinder 202 via a second channel 238. The housing 214 can also include one or more plugs 232 to protect the fluid integrity of the valve housing 214.

The system 200 can further include an inlet check valve 222 disposed near the inlet 216 of the valve housing 214. The inlet check valve 222 can allow fluid 246 to enter through the inlet 216 or restrict flow therethrough. In the manner, the inlet check valve 222 is in fluid communication with the inlet 216. Fluid flow through the inlet 216 and to the cylinder 202 can be metered by a spool valve 250. As shown, the spool valve 250 is disposed within the housing 214 in a substantially horizontal orientation. The spool valve 250 can be controlled mechanically by a spring assembly 228. The spool valve 228 may also be controlled pneumatically, electrically, hydraulically, or by any other known means. During operation, the spool valve 250 can move between an open position and closed position to allow hydraulic fluid 246 to flow from the inlet 216 to the first port 218. In this position, the inlet 216 and first port 218 are in fluid communication with one another.

Figure 2:
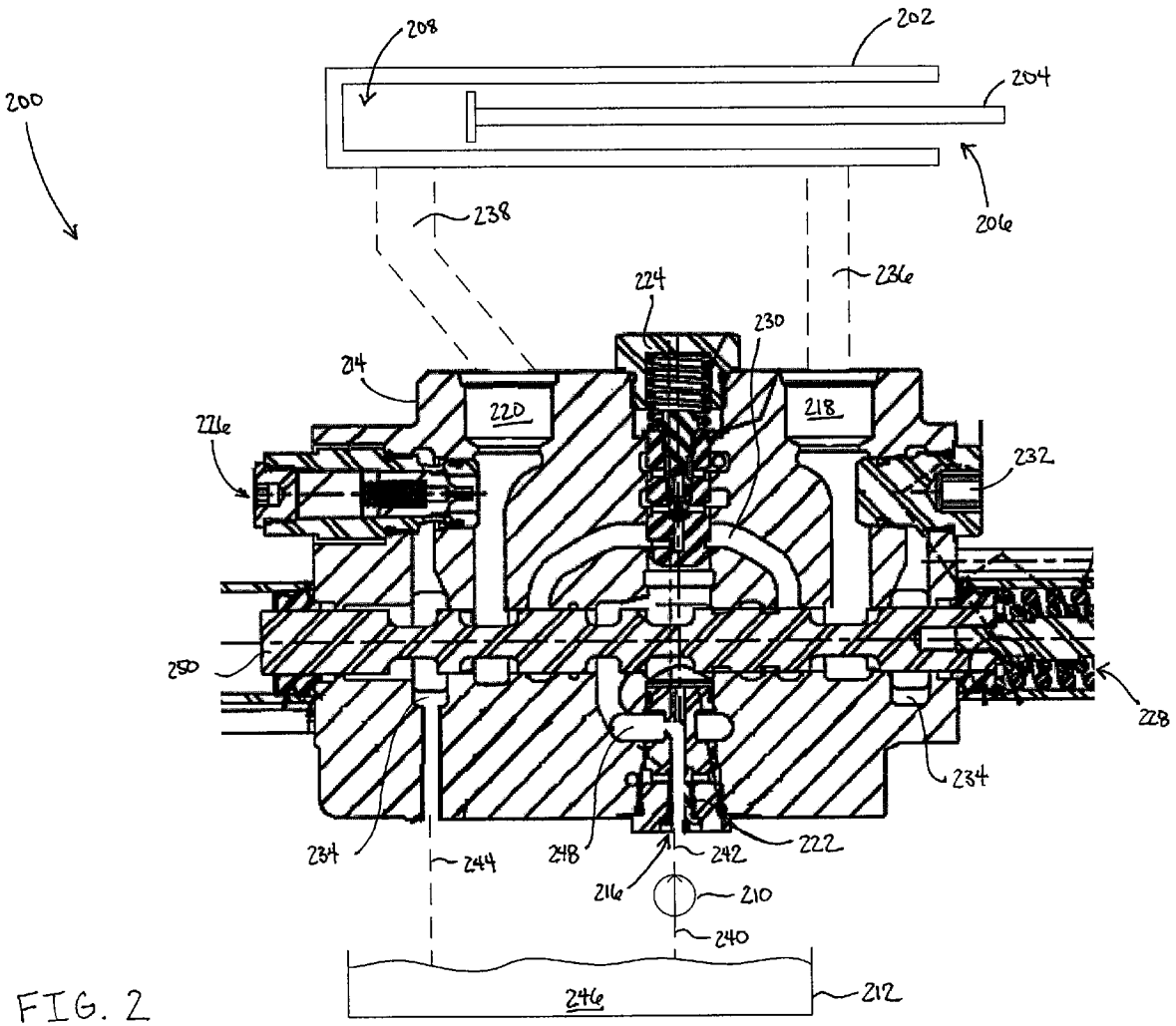
FIG. 2 is a partial cross-section and schematic view of a valve housing.

A compensator valve 224 can also be disposed in the housing in a defined passage in the housing 214. The compensator valve 224 can be oriented substantially vertically and at least partially aligned with the inlet check valve 222. The compensator valve 224 can maintain a substantially constant pressure drop across the spool valve 250 by restricting flow through a bridge-like channel 230 defined in the housing 214. The bridge channel 230 can be substantially U-shaped, as shown in FIG. 2, such that one arm of the bridge channel 230 fluidly couples the spool valve 250, inlet 216 and first port 218 to one another. In other words, when the spool valve 250 is in the open position, the compensator valve 224 stabilizes the pressure drop across the spool valve 250.

During operation, fluid 246 in the tank reservoir 212 can enter an input side 240 of the pump 210 and be pumped through a passage 242 to the inlet 216. When the inlet check valve 222 opens, fluid 246 can be pumped into a pump galley 248 where the fluid collects until the spool valve 250 is opened. The fluid flow will be further described below with respect to FIG. 3.

The system 200 can include a proportional control element 226 to perform exhaust metering of the fluid flow therethrough. The proportional control element 226 can be in the form of a defined orifice, a valve, a solenoid, a combination thereof, or any other known proportional control device. The proportional control element 226 can be in fluid communication with the second port 220 such that fluid passing through the second port 220 can be exhausted through or by the proportional control element 226. Fluid exhausted by the proportional control element 226 can enter and collect in a tank galley 234, which is in fluid communication with the tank reservoir.

During operation, hydraulic fluid pressurized in the second end 208 of the cylinder 202 can be exhausted through the second port 220 and released into the tank reservoir 212. To do so, fluid passes through a second channel 238 and enters the valve housing 214 through the second port 220. The proportional control element 226 serves as a means for exhaust metering and restricts flow therethrough. In doing so, the proportional control element 226 can assist with lowering the work implement. Advantageously, the proportional control element 226 can be controlled independently from the spool valve 250. As such, inlet metering and exhaust metering can be achieved by independent control and without requiring multiple spool valves. In other words, the proportional control element 226 and the spool valve 250 can be opened and closed independent of the other.

Figure 3:
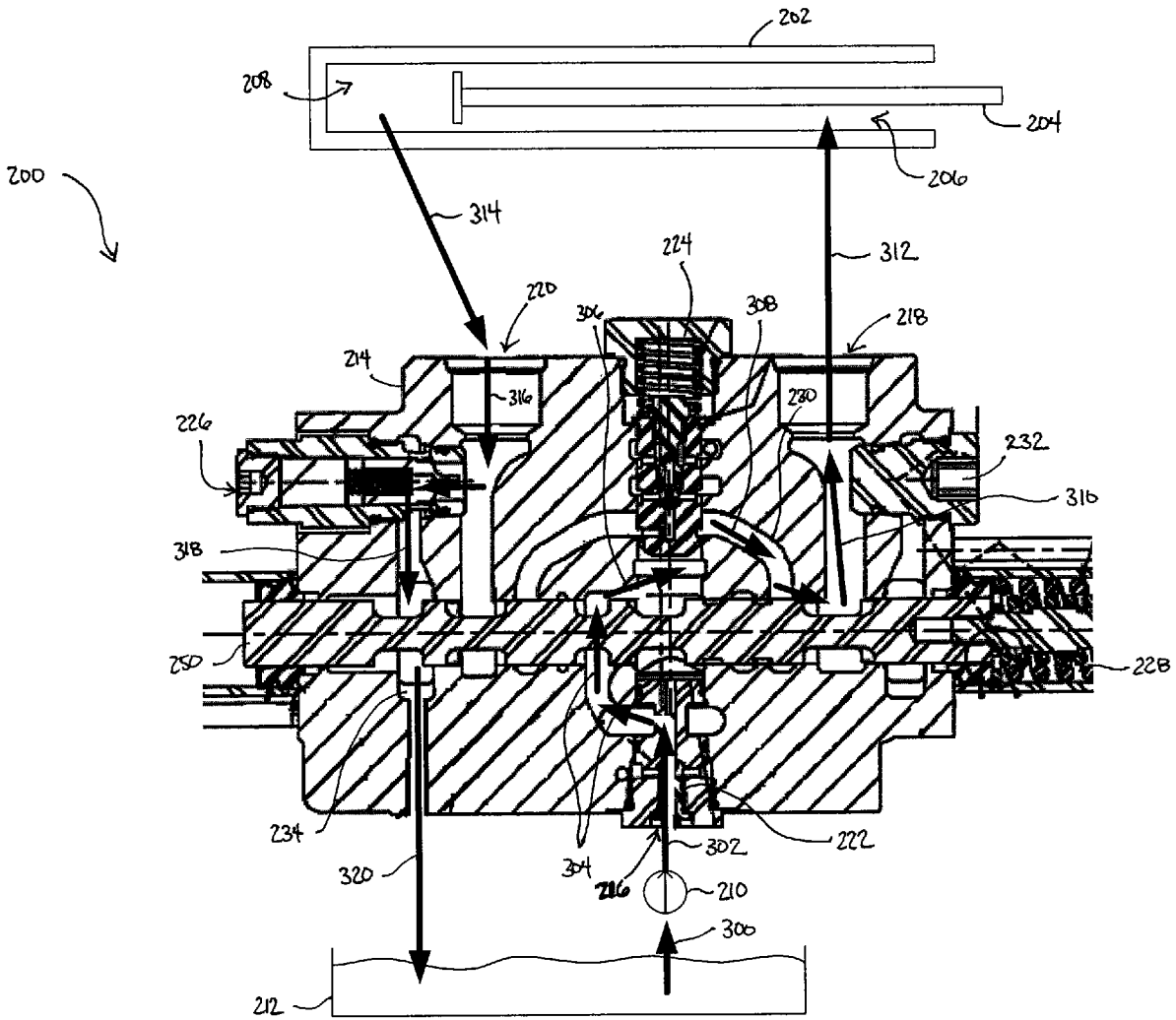
FIG. 3 is a partial cross-section and schematic view of fluid flow through the valve housing of FIG. 2.

Referring to the embodiment of FIG. 3, fluid paths are shown for inlet and exhaust metering in the hydraulic system 200. In particular, there can be at least two different flow paths. The first flow path is indicated by arrows 300, 302, 304, 306, 308, 310, and 312 and the second flow path is indicated by arrows 314, 316, 318, and 320.

During operation, hydraulic fluid can enter the pump inlet along the direction indicated by arrow 300. The pump 210 then pumps the fluid through the inlet 216 of the valve housing 214 along the direction indicated by arrow 302. Again, the fluid flow passes through the inlet 216 so long as the inlet check valve 222 opens. Once the fluid passes the inlet check valve 222, the flow path continues into the pump galley 248 (see FIG. 2) along the direction indicated by arrow 304. In the open position, the fluid can flow past the spool valve 250 along the direction indicated by arrow 306. The compensator valve 224 monitors and stabilizes a substantially constant fluid pressure drop across the spool valve 250.

The hydraulic fluid can then be pumped through the bridge-like channel 230 along the direction indicated by arrow 308. Once the fluid exits the bridge-like channel 230, the fluid path continues along the direction indicated by arrow 310 until the fluid reaches the first port 218. Fluid can continue to be pumped out of the first port 218 and into the first end 206 of the cylinder 202 along the direction indicated by arrow 312. Fluid pressure can therefore enter the first end 206 of the cylinder 202 and push the rod 204 towards the second end 208 to build pressure therein.

As hydraulic pressure builds in the second end 208 of the cylinder 202, a second fluid path is formed. In particular, fluid can be exhausted to allow better control of a load being lowered by a vehicle through exhaust metering. The second flow path can include exhausting fluid from the second end 208 of the cylinder 202 to the second port 220 of the valve housing 214 along a direction indicated by arrow 314. The fluid can enter the second port 220 along the direction indicated by arrow 316. The proportional control element 226 can be opened by activating a solenoid or opening a valve, for example, to allow the fluid to pass along the direction indicated by arrow 318 and collect in the tank galley 234. Fluid can then be exhausted into the tank reservoir 212 along the direction indicated by arrow 320.

As shown, the first and second flow paths are at least partially parallel to one another. Further, when the inlet check valve 222, spool valve 250, and proportional control element 226 are opened, the first and second flow paths are in fluid communication with one another. Further, the pump 210, cylinder 202, and tank reservoir 212 are in fluid communication with one another in this embodiment as well.

Other valves and control elements can be disposed in the valve housing 214 to alter the flow paths as desired and further pressurize the cylinder 202 to achieve desired results.

While exemplary embodiments incorporating the principles of the present invention have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A hydraulic system including a reservoir, the hydraulic system for controlling a load, comprising:

a housing defining an inlet, a first port, a second port, and a tank galley coupled to the reservoir;

a spool valve, including a spool configured to move within the housing, the spool being in fluid communication with the inlet, the first port, the second port, and the tank galley, wherein the spool is configured to meter fluid flow from the inlet to the first port and to meter fluid flow from the second port to the tank galley simultaneously due to the configuration of the spool; and a proportional control element, disposed in the housing and in fluid communication with the second port, wherein the proportional control element is configured to control the fluid flow from the second port, through the housing and past the spool, to the tank galley, and to the reservoir;

wherein, the proportional control element and the spool valve are configured to be controlled independently of one another.

2. The system of claim 1, wherein the proportional control element comprises a solenoid.

3. The system of claim 1, wherein the proportional control element comprises a pressure relief orifice.

4. The system of claim 1, wherein the proportional control element comprises an open position and a closed position, the second port, the reservoir, and a pump defining a fluid path with the inlet in the open position.

5. The system of claim 1, further comprising a cylinder being in fluid communication with the first port and the second port.

6. The system of claim 5, further comprising a pump in fluid communication with the inlet.

7. The system of claim 6, further comprising an inlet valve disposed near the inlet, the inlet valve configured to fluidly couple the pump to the first port.

8. The system of claim 1, further comprising a bridge channel defined in the housing, the bridge channel being fluidly coupled between the inlet and the first port.

9. The system of claim 1, further comprising a compensator valve disposed in the housing between the first port and the second port, the compensator valve being in fluid communication with the spool valve and configured to maintain a pressure drop across the spool valve.

10. A hydraulic system for controlling a work element attached to an off road work vehicle, comprising:

a housing defining an inlet, a first port, a second port, and a tank galley;

a pump configured to be in fluid communication with the inlet;

a cylinder assembly including a rod, the cylinder assembly having a first end fluidly coupled to the first port and a second end fluidly coupled to the second port;

a single spool valve disposed in the housing, the spool valve being moveable to an open position to fluidly couple and to meter fluid flow from the inlet and the first port, wherein the single spool valve is further configured in the open position to selectively fluidly couple and to meter fluid flow from the second port to the tank galley, and wherein the metered fluid flow from the inlet to the first port and the metered fluid flow from the second port to the tank galley is made at the same time due to the configuration of the single spool valve; and a proportional control element disposed in the housing and being in fluid communication with the second port and the tank galley, wherein the proportional control element is configured to proportionally control the fluid flow from the second port, past the single spool valve, and to the tank galley;

wherein, the single spool valve and the proportional control element are controlled independently of one another.

11. The hydraulic system of claim 10, further comprising an inlet valve disposed near the inlet, wherein the inlet and first port are fluidly coupled when the inlet valve and spool valve are disposed in open positions.

12. The hydraulic system of claim 10, further comprising a fluid path defined between the inlet and first port, the fluid path including a bridge portion between the spool valve and first port.

13. The hydraulic system of claim 10, further comprising a compensator valve disposed in a defined passage in the housing between the first port and the second port, the compensator valve being in fluid communication with the spool valve and configured to maintain a relatively constant pressure drop across the spool valve.

14. The hydraulic system of claim 10, further comprising:

a tank reservoir in fluid communication with the pump; and a solenoid for controlling the proportional control element;

wherein, the solenoid causes the proportional control element to exhaust fluid from the second port to the tank reservoir and through the tank galley without moving the spool valve.

15. The hydraulic system of claim 10, further comprising:

a first flow path defined in the housing and in fluid communication with the inlet and the first port; and a second flow path defined in the housing and in fluid communication with the second port;

wherein the first flow path and second flow path are at least partially parallel to one another.

16. The hydraulic system of claim 10, further comprising:

a tank reservoir in fluid communication with the tank galley and with the pump;

a first configuration in which the spool valve is in the open position and the proportional control element is in a closed position, where the inlet is fluidly coupled to the first port;

a second configuration in which the spool valve is in a closed position and the proportional control element is in an open position, where fluid can flow from the second port past the proportional control element; and a third configuration in which the spool valve and proportional control element are both open, where the first port, second port, and inlet define a fluid path through the reservoir and through the pump.

17. The hydraulic system of claim 1, wherein the spool is configured to include a first notch and a second notch located a predetermined distance from the first notch, wherein the spool is configured to be moveable between an open position and a closed position, the open position configured to meter fluid flow past the first notch between the inlet and the first port and to meter fluid flow past the second notch between the second port and the tank galley.

* * * * *